US007580657B2

(12) United States Patent
Tateyama et al.

(10) Patent No.: US 7,580,657 B2
(45) Date of Patent: Aug. 25, 2009

(54) DEVELOPING DEVICE IN IMAGE-FORMING DEVICE

(75) Inventors: Susumu Tateyama, Hitachinaka (JP); Yoshitaka Fujinuma, Hitachinaka (JP); Tsutomu Nakagawa, Hitachinaka (JP); Masayoshi Nakayama, Hitachinaka (JP)

(73) Assignee: Ricoh Company, Ltd., Tokyo (JP)

( * ) Notice: Subject to any disclaimer, the term of this patent is extended or adjusted under 35 U.S.C. 154(b) by 161 days.

(21) Appl. No.: 11/493,856

(22) Filed: Jul. 27, 2006

(65) Prior Publication Data

US 2007/0025773 A1 Feb. 1, 2007

(30) Foreign Application Priority Data

Jul. 28, 2005 (JP) ..... P2005-219084

(51) Int. Cl.
*G03G 15/08* (2006.01)

(52) U.S. Cl. ..... 399/256

(58) Field of Classification Search ..... 399/256, 399/61, 254

See application file for complete search history.

(56) References Cited

U.S. PATENT DOCUMENTS 5,508,793 A * 4/1996 Kimura et al. ..... 399/63
2006/0029431 A1* 2/2006 Tanaka et al. ..... 399/254

FOREIGN PATENT DOCUMENTS

JP 11167260 A * 6/1999
JP 2001249545 9/2001

OTHER PUBLICATIONS

Machine translation of JP 11167260.*

* cited by examiner

*Primary Examiner*—David M Gray
*Assistant Examiner*—Andrew V Do
(74) *Attorney, Agent, or Firm*—Whitham Curtis Christofferson & Cook, PC

(57) ABSTRACT

A developing device includes first-third sections, a developing roller, a partitioning wall and a toner concentration detector. The first-third sections have first-third screw augers respectively. The partitioning wall isolates the third section from the first section and the second section. A supply opening is formed in a portion of the partitioning wall opposing the first section. A toner concentration detector is disposed in the third section. The first screw auger conveys developer including toner to the developing roller, into the third section via the supply opening, and into the second section. The second screw auger conveys developer accommodated in the second section into the third section. The third screw auger conveys developer accommodated in the third section into the first section. Toner is replenished into the third section based on a detection result by the toner concentration detector.

18 Claims, 6 Drawing Sheets

DEVELOPING DEVICE IN IMAGE-FORMING DEVICE

BACKGROUND OF THE INVENTION

1. Field of the Invention

The present invention relates to a developing device capable of supplying developer of a uniform concentration with stability and an image-forming device, such as a photocopier or printer, equipped with this developing device.

2. Description of Related Art

An image-forming device well known in the art, such as a photocopier, forms an electrostatic latent image on an image-carrying member by irradiating light from a laser light source or a light-emitting diode (LED) onto the image-carrying member based on image data. The latent image is developed with toner and the developed image is subsequently transferred onto a sheet and fixed to the sheet with heat. The image-forming device develops electrostatic latent images formed on the image-carrying member into visible images using either a single-component developer or a double-component developer including a toner and carrier.

When using a double-component developer, a magnetic developing roller is provided around the image-carrying member and is configured of a plurality of fixed magnetic poles and a sleeve capable of rotating around the magnetic poles. The magnetic developing roller forms a magnetic brush by magnetically attracting developer. As the sleeve rotates, the magnetic brush is conveyed over the image-carrying member.

The magnetic brush deposits toner suited to the potential of the latent image formed on the image-carrying member to develop the latent image. After development, the developer is recovered and reused together with an external supply of toner for developing latent images.

For forming stable toner images, the developer used in this construction must be supplied in a uniform amount (having a uniform toner concentration) and must be maintained at a specific charge amount to be attracted to the potential of the latent images formed on the image-carrying member.

The concentration of the toner changes depending on distribution of the amount of toner consumed during development and newly supplied toner, and the charge amount of the toner changes depending on friction produced when the toner and carrier are mixed together. Therefore, the developing device must sufficiently agitate the developer composed of a toner and carrier to achieve a uniform distribution of toner concentration, and saturate the toner with the applied charge amount in order to produce stable toner images.

One such developing device disclosed in Japanese unexamined patent application publication No. 2001-249545 is shown in FIGS. 1A-1C and 2A-2D.

First, a conventional developing device will be described with reference to FIGS. 1A-1C, which include conceptual drawings of a developing device having a plurality of screw augers. FIG. 1A is a cross-sectional view taken along a line A-A' in FIG. 1B of a developing device 40. FIG. 1B is a side view in a direction X shown in FIG. 1A revealing the interior of the developing device 40. FIG. 1C is an explanatory diagram illustrating the direction in which developer is conveyed in the developing device 40. The conveying direction for developer is indicated by arrows in FIG. 1C.

As shown in FIG. 1A, the developing device 40 includes a magnetic developing roller 80; and three screw augers 90*a*, 100*a*, and 110*a*. Three screw auger sections 90, 100, and 110 are formed in the developing device 40 and isolated from each other by a partitioning wall 150.

The first screw auger section 90 and the second screw auger section 100 are juxtaposed vertically with the first screw auger section 90 on the top and the second screw auger section 100 on the bottom, and the third screw auger section 110 is disposed between the first screw auger section 90 and second screw auger section 100 with respect to the vertical. A drive source (not shown) produces a driving force for rotating the screw augers 90*a*, 10*a*, and 110*a* so that the screw augers 90*a*, 100*a*, and 110*a* agitate and convey developer.

The screw auger 90*a* agitates the developer while conveying the developer toward the magnetic developing roller 80. The sleeve of the magnetic developing roller 80 rotating clockwise in FIG. 1A holds the developer supplied from the screw auger 90*a* with magnetic force, forming a magnetic brush.

Developer not supplied to the magnetic developing roller 80 is conveyed to a downstream position in the first screw auger section 90 (in the left of FIG. 1B), and drops down into the second screw auger section 100 through a third opening N30.

Developer used in development and therefore having a decreased toner concentration is also recovered from the magnetic developing roller 80 by the second screw auger 100. The second screw auger 100 agitates and conveys the developer toward a downstream position (the left of FIG. 1B).

After a fixed amount of developer is accumulated in this downstream position of the second screw auger section 100, the developer migrates diagonally upward to the third screw auger section 110 through a first opening N10.

Developer that has migrated to the third screw auger section 110 is agitated and conveyed by the screw auger 110*a* together with new toner supplied through a supply opening N40. The screw auger 11*a* conveys this developer to a downstream position (right in FIG. 1B).

Next, another conventional developing device will be described with reference to FIGS. 2A-2D, which are a conceptual drawing of a developing device having a plurality of screw augers. In FIGS. 2A-2D, like parts and components to those in FIGS. 1A-1C have been designated with the same reference numerals to avoid duplicating description.

FIG. 2A is a center cross-sectional view of the developing device 40 taken along a line B-B' shown in FIG. 2D. FIG. 2B is a cross-sectional view along a line C-C' in FIG. 2D through one end of the developing device 40. FIG. 2C is a cross-sectional view along a line D-D' in FIG. 2D through another end of the developing device 40. FIG. 2D is a side view along a direction X shown in FIG. 2A revealing the interior of the developing device 40.

In this conventional developing device, a screw auger 110*a* is oriented so that the downstream end is positioned higher than the upstream end in the direction for conveying developer in the third screw auger section 110 (see FIG. 2B).

In the developing device 40 shown in FIGS. 1A-1C and 2A-2D, the second screw auger section 100 recovers developer having a depleted toner concentration following development. The recovered developer is replenished with new toner, since some of the toner has been consumed for developing a latent image, and is reused for development. In order to replenish the new toner, a toner concentration sensor for detect the toner concentration is disposed in the third screw auger section 110.

However, in the conventional structures described above, when performing high-density printing in which a large amount of toner is consumed during development, the toner concentration drops remarkably. Therefore, it is necessary that a large amount of toner is provided to the third screw auger section 110. In such a case, since the recovered developer and the new toner are agitated only in the third screw auger section 110, they are not agitated sufficiently. Thus, the toner concentration in the developer detected by the toner concentration sensor becomes irregular, and consequently the density of the image formed on the sheet becomes unstable.

SUMMARY OF THE INVENTION

In view of the foregoing, it is an object of the present invention to provide a developing device and an image-forming device for forming images of a stable quality.

In order to attain the above and other objects, the present invention provides a developing device including a first section, a second section, a third section, a developing roller, a partitioning wall and a toner concentration detector. The first section, second section and third section are configured to accommodate developer including toner and carrier therein, and have a first screw auger, a second screw auger and a third screw auger respectively that rotate to agitate and convey the developer. The developing roller supplies developer to an image-carrying member on which latent images are formed in order to develop the latent image. The partitioning wall isolates the third section from the first section and the second section. A first opening and a supply opening are formed in portions of the partitioning wall opposing the first section. A second opening is formed in a portion of the partitioning wall opposing the second section. A toner concentration detector is disposed in the third section, and detects concentration of toner in developer accommodated in the third section. The first screw auger conveys developer accommodated in the first section to the developing roller, into the third section via the supply opening, and into the second section. The second screw auger conveys developer accommodated in the second section into the third section via the second opening. The third screw auger conveys developer accommodated in the third section into the first section via the first opening. Toner is replenished into the third section based on a detection result by the toner concentration detector.

It is preferable that the second screw auger conveys developer remaining on the developing roller after the developing roller has developed the latent image into the third section via the second opening, in addition to the developer conveyed into the second section by the first screw auger.

It is preferable that the third screw auger conveys, into the first section, the developer conveyed into the third section by the second screw auger, the developer conveyed into the third section via the supply opening by the first screw auger, and the toner replenished into the third section.

It is preferable that the supply opening is positioned upstream of the toner concentration detector in a conveying direction of developer in the third section.

It is preferable that a replenishing opening is formed at the third section and at an upstream of the supply opening in a conveying direction of developer in the third section.

It is preferable that the second opening is formed at an upstream of the supply opening in a conveying direction of developer in the third direction.

It is preferable that a plurality of supply openings is formed in the partitioning wall.

It is preferable that the first screw auger, the second screw auger and the third screw auger include a first rotational shaft, a second rotational shaft and a third rotational shaft, respectively, the first rotational shaft, the second rotational shaft and the third rotational shaft being arranged parallel to a rotational shaft of the image-carrying member.

It is preferable that the first screw auger, the second screw auger and the third screw auger include a first rotational shaft, a second rotational shaft and a third rotational shaft respectively, the first rotational shaft and the second rotational shaft being arranged parallel to a rotational shaft of the image-carrying member, the third rotational shaft being arranged at an incline with respect to the rotational shaft of the image-carrying member.

Another aspect of this invention provides an image-forming device including an image-carrying member and a developing device. Latent image are formed on the image-carrying member. The developing device includes a first section, a second section, a third section, a developing roller, a partitioning wall and a toner concentration detector. The first section, second section and third section are configured to accommodate developer including toner and carrier therein, and have a first screw auger, a second screw auger and a third screw auger respectively that rotate to agitate and convey the developer. The developing roller supplies developer to an image-carrying member in order to develop the latent image. The partitioning wall isolates the third section from the first section and the second section. A first opening and a supply opening are formed in portions of the partitioning wall opposing the first section. The second opening is formed in a portion of the partitioning wall opposing the second section. The toner concentration detector is disposed in the third section, and detects concentration of toner in developer accommodated in the third section. The first screw auger conveys developer accommodated in the first section to the developing roller, into the third section via the supply opening, and into the second section. The second screw auger conveys developer accommodated in the second section into the third section via the second opening. The third screw auger conveys developer accommodated in the third section into the first section via the first opening. Toner is replenished into the third section based on a detection result by the toner concentration detector.

It is preferable that the second screw auger conveys developer remaining on the developing roller after the developing roller has developed the latent image into the third section via the second opening, in addition to the developer conveyed into the second section by the first screw auger.

It is preferable that the third screw auger conveys, into the first section, the developer conveyed into the third section by the second screw auger, the developer conveyed into the third section via the supply opening by the first screw auger, and the toner replenished into the third section.

It is preferable that the supply opening is positioned upstream of the toner concentration detector in a conveying direction of developer in the third section.

It is preferable that a replenishing opening is formed at the third section and at an upstream of the supply opening in a conveying direction of developer in the third section.

It is preferable that the second opening is formed at an upstream of the supply opening in a conveying direction of developer in the third direction.

It is preferable that a plurality of supply openings is formed in the partitioning wall.

It is preferable that the first screw auger, the second screw auger and the third screw auger include a first rotational shaft, a second rotational shaft and a third rotational shaft respectively, the first rotational shaft, the second rotational shaft and the third rotational shaft being arranged parallel to a rotational shaft of the image-carrying member.

It is preferable that the first screw auger, the second screw auger and the third screw auger include a first rotational shaft, a second rotational shaft and a third rotational shaft respectively, the first rotational shaft and the second rotational shaft being arranged parallel to a rotational shaft of the image-carrying member, the third rotational shaft being arranged at an incline with respect to the rotational shaft of the image-carrying member.

BRIEF DESCRIPTION OF THE DRAWINGS

The above and other objects, features and advantages of the invention will become more apparent from reading the following description of the preferred embodiments taken in connection with the accompanying drawings in which.

DETAILED DESCRIPTION OF THE PREFERRED EMBODIMENTS

Figure 1A:
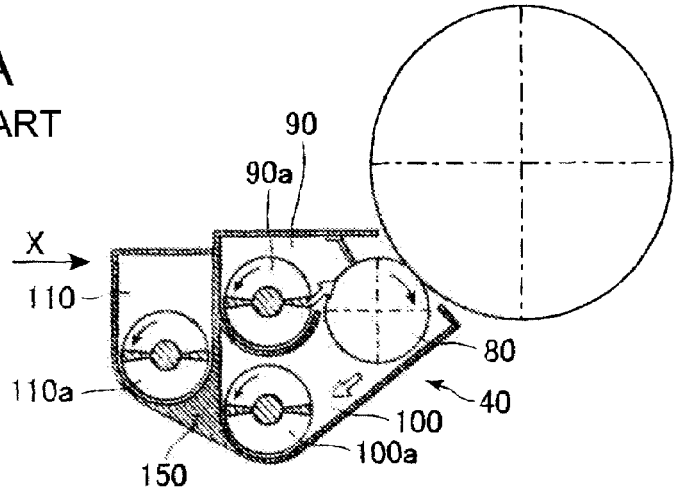
FIG.1A PRIOR ART
FIG. 1A is a cross-sectional view of a conventional developing device.
Figure 1B:
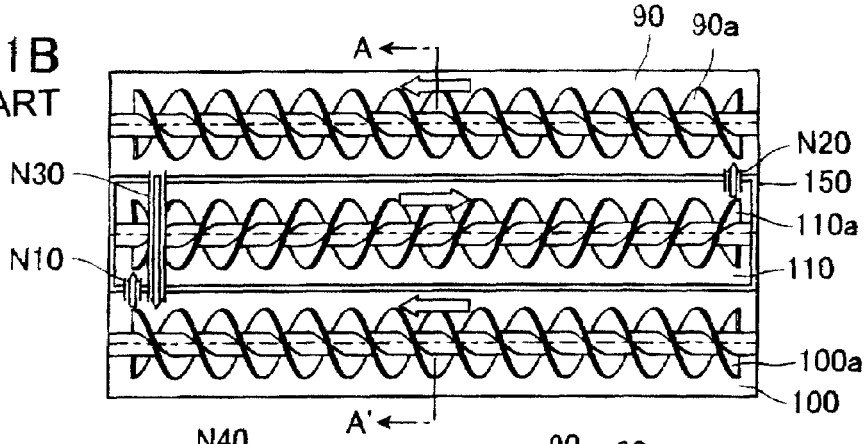
FIG.1B PRIOR ART
FIG. 1B is a side view from a perspective along a direction X shown in FIG. 1A revealing the interior of the developing device.
Figure 1C:
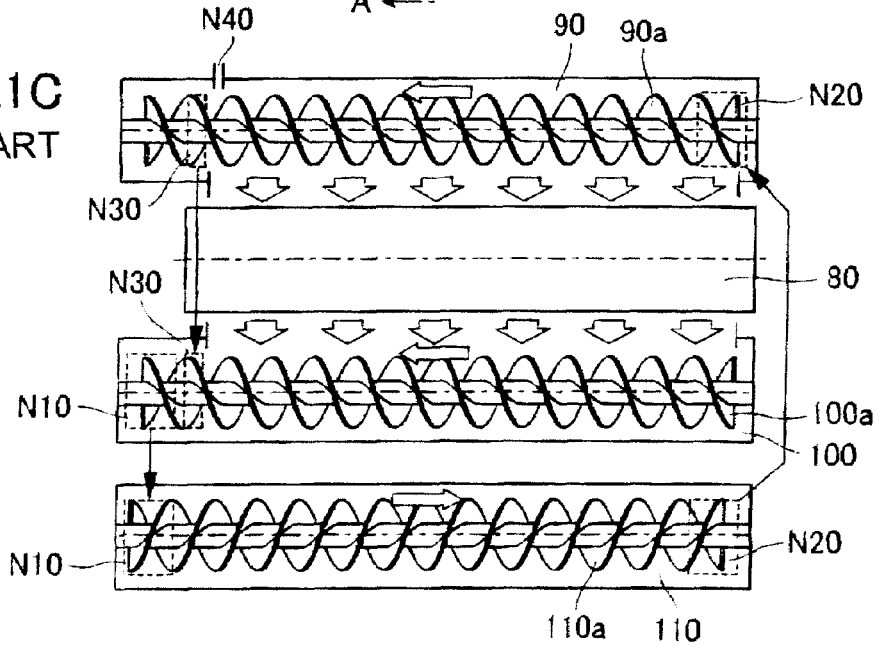
FIG.1C PRIOR ART
FIG. 1C is an explanatory diagram illustrating the direction in which developer is conveyed in the developing device.
Figure 2A:
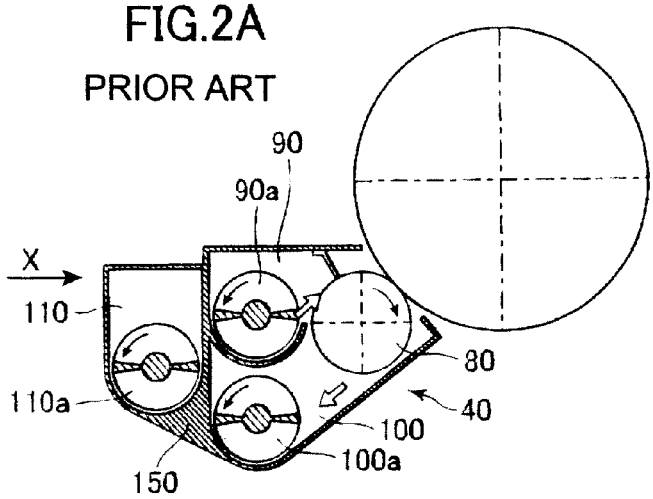
FIG.2A PRIOR ART
FIG. 2A is a cross-sectional view of another conventional developing device.
Figure 2B:
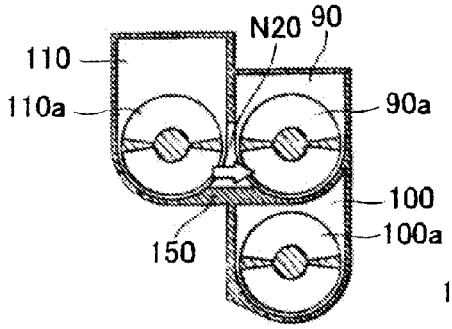
FIG.2B PRIOR ART
FIG. 2B is a cross-sectional view of the developing device along one end.
Figure 2C:
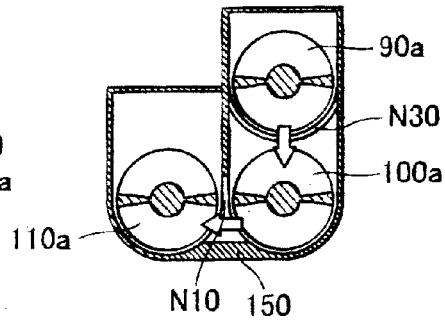
FIG.2C PRIOR ART
FIG. 2C is a cross-sectional view of the developing device along another end.
Figure 2D:
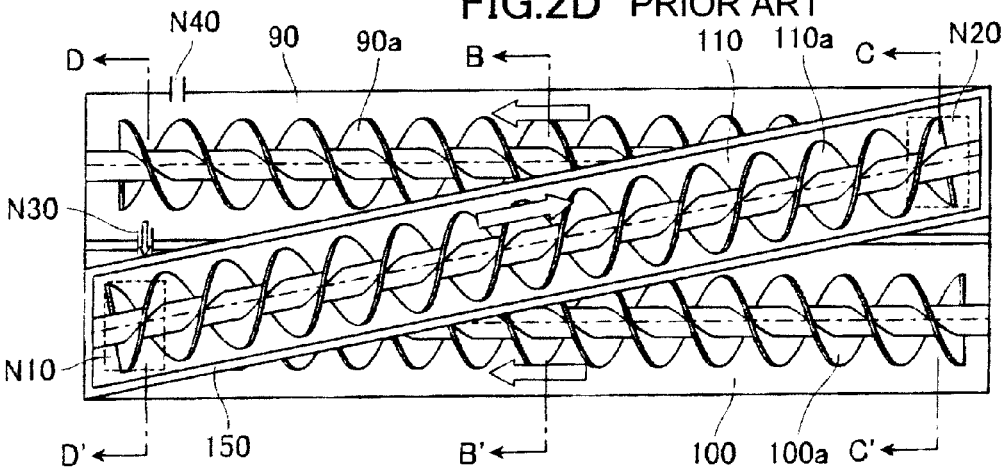
FIG.2D PRIOR ART
FIG. 2D is a cross-sectional view from a perspective along a direction X shown in FIG. 2A revealing the interior of the developing device.

An image-forming device and a developing device according to preferred embodiments of the present invention will be described while referring to the accompanying drawings wherein like parts and components are designated by the same reference numerals to avoid duplicating description.

In the following description, the expressions "front", "rear", "upper", "lower", "right", and "left" are used to define the various parts when the developing device is disposed in an orientation in which it is intended to be used.

Figure 3:
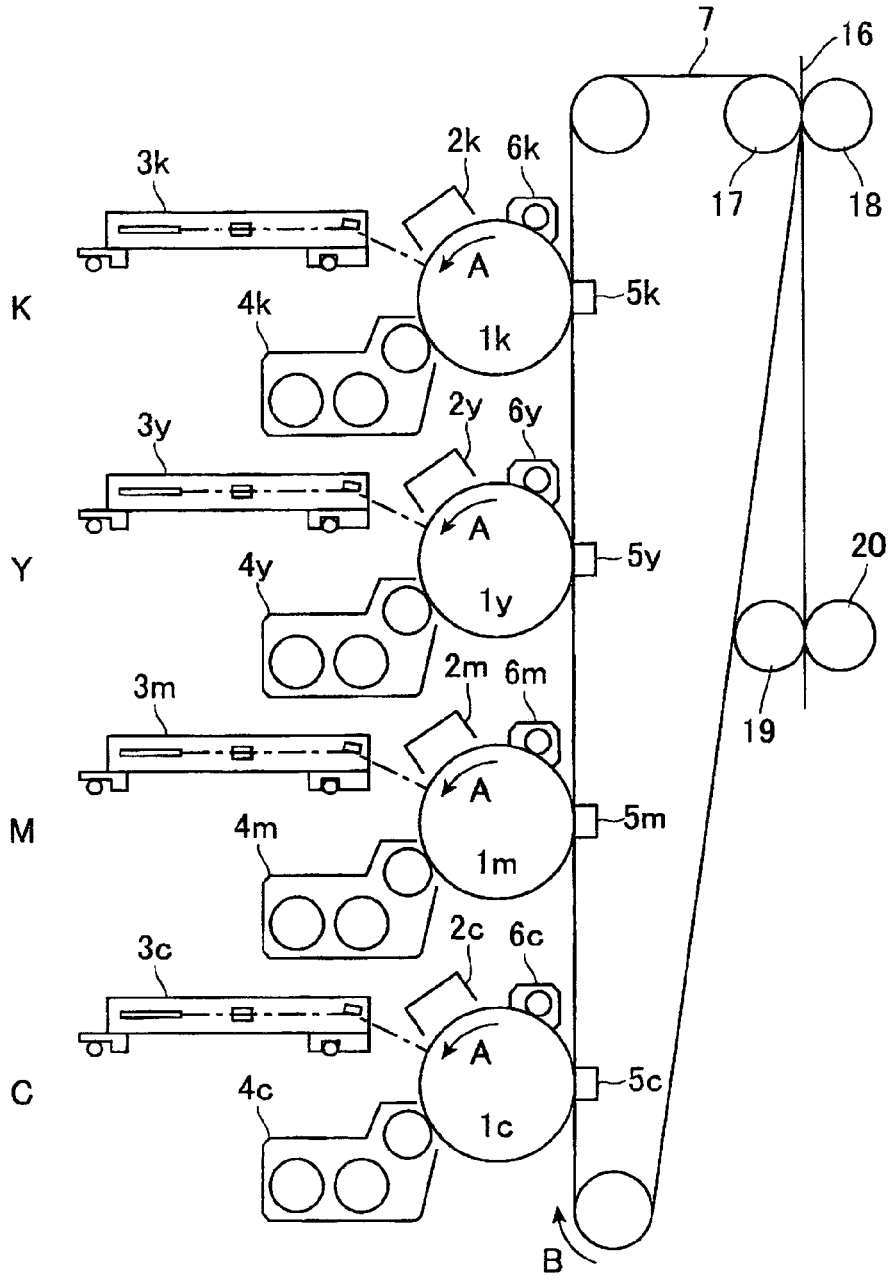
FIG. 3 is a cross-sectional view showing the overall structure of an image-forming device according to a preferred embodiment of the present invention.

FIG. 3 is a cross-sectional view showing the overall structure of an image-forming device according to the preferred embodiment. The image-forming device includes optical scanning systems and image-carrying members provided independently for each of the black, cyan, yellow, and magenta color components. The image-forming device in the preferred embodiment is a tandem color printer for printing color images by first superimposing images of each color on an intermediate transfer member and subsequently transferring the superimposed images onto paper.

The tandem color printer shown in FIG. 3 is an electrophotographic printing device that includes visible-toner image forming units provided for each color. The image forming units include a black forming unit K, a yellow forming unit Y, a magenta forming unit M, and a cyan forming unit C arranged as shown in FIG. 3.

The visible toner image forming units K, Y, M, and C include respective drum-type image-carrying members 1*k*, 1*y*, 1*m*, and 1*c*. Disposed in order around the image-carrying members image-carrying members 1*k*-1*c* are respective chargers 2*k*, 2*y*, 2*m*, and 2*c*; optical scanning devices 3*k*, 3*y*, 3*m*, and 3*c*; developing devices 4*k*, 4*y*, 4*m*, and 4*c*; transfer units 5*k*, 5*y*, 5*m*, and 5*c*; and cleaning devices 6*k*, 6*y*, 6*m*, and 6*c*. The image-carrying members 1*k*-1*c* are driven to rotate in the direction indicated by arrows A in FIG. 3.

In the color printer having this construction, the chargers 2*k*-2*c* uniformly charge the surfaces of the respective image-carrying members 1*k*-1*c*. Subsequently, the optical scanning devices 3*k*-3*c* irradiate light onto the charged surfaces of the image-carrying members 1*k*-1*c* to form electrostatic latent images thereon.

The developing devices 4*k*-4*c* supply toner of the corresponding color to the electrostatic latent images formed on the surfaces of the image-carrying members 1*k*-1*c*, forming toner images thereon. The transfer units 5*k*-5*c* subsequently transfer the developed toner images from the image-carrying members 1*k*-1*c* onto an intermediate-transfer member 7. The intermediate transfer member 7 is an endless belt conveyed in a direction B indicated in FIG. 3. The toner images carried on the intermediate transfer member 7 are subsequently transferred onto a recording medium 16 between pressure rollers 17 and 18. The toner image is then fixed to the recording medium 16 as the recording medium 16 passes between a heating roller 19 and a pressure roller 20, thereby forming a color image on the recording medium 16.

Next, a developing device employed in the image-forming device having this construction will be described with reference to FIGS. 4A-4D.

Figure 4A:
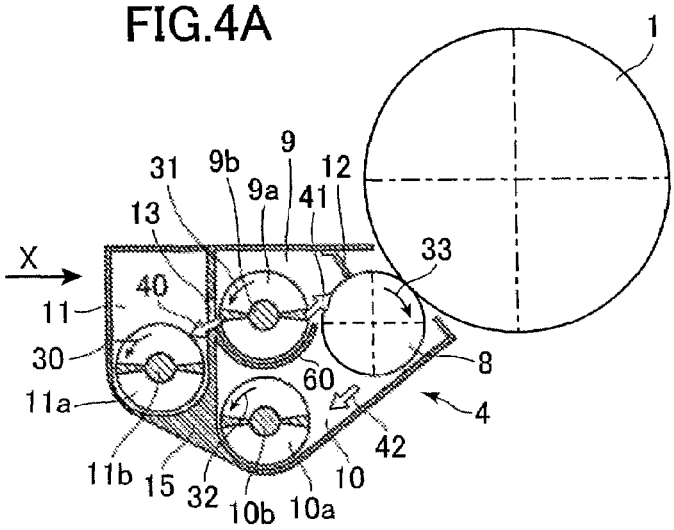
FIG. 4A is a cross-sectional view showing the structure of a developing device according to a preferred embodiment of the present invention.
Figure 4B:
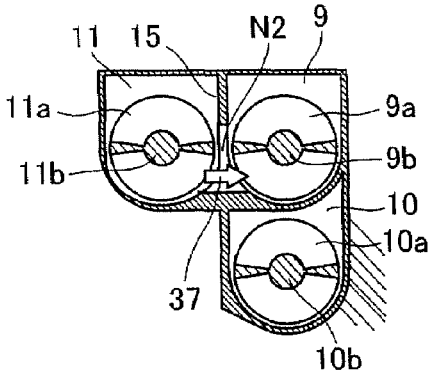
FIG. 4B is a cross-sectional view of the developing device along one end.
Figure 4C:
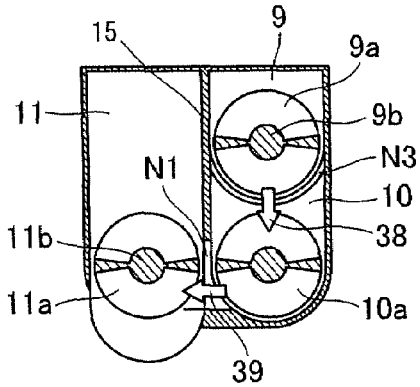
FIG. 4C is a cross-sectional view of the developing device along another end.
Figure 4D:
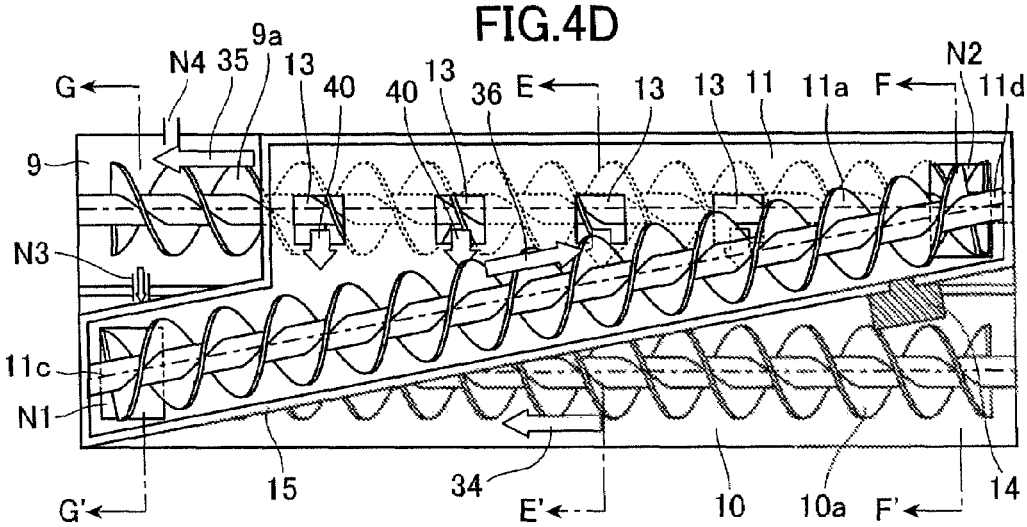
FIG. 4D is a cross-sectional view from a perspective along a direction X shown in FIG. 4A revealing the interior of the developing device.

FIGS. 4A-4D include conceptual drawings of the developing device 4 having a plurality of screw augers. FIG. 4A is a cross-sectional view of the developing device 4 taken along a line E-E' in FIG. 4D. FIG. 4B is a cross-sectional view along a line F-F' in FIG. 4D. FIG. 4C is a cross-sectional view taken along a line G-G' in FIG. 4D. FIG. 4D is a side view along a direction X shown in FIG. 4A revealing the interior of the developing device 4. In FIGS. 4A, 4B, 4C, and 4D, arrows 30, 31, 32, and 33 indicate the rotational direction of the magnetic developing roller 8, screw auger 9*a*, screw auger 10*a*, and screw auger 11*a*, respectively; outline arrows 34, 35, 36, 37, 38, 39, 40, 41, and 42 indicate the direction in which developer migrates.

The developing device 4 includes the magnetic developing roller 8; the first, second, and third screw auger sections 9, 10, and 11; a partitioning wall 15; a partitioning portion 60; and the blade 12. Screw augers 9*a*, 10*a*, and 11*a* are rotatably supported in the screw auger sections 9, 10, and 11 on rotational shafts 9*b*, 10*b*, and 11*b*. *A drive source* (not shown) generates a driving force for rotating the screw augers 9*a*, 1*a*, and 11*a* in the direction of the arrows 30, 31, and 32 shown in FIG. 4A respectively.

The partitioning wall 15 is provided to isolate the third screw auger section 11 from the first screw auger section 9 and second screw auger section 10. The partitioning portion 60 is provided to separate the first screw auger section 9 from the second screw auger section 10. A first opening N1 is formed in a portion of the partitioning wall 15 opposing the second screw auger section 10 (FIG. 4C). A second opening N2 is formed in a portion of the partitioning wall 15 opposing the first screw auger section 9 (FIG. 4B) A third opening N3 is formed in the partitioning portion 60 (FIG. 4D). A supply opening N4 through which developer is supplied is formed in the third screw auger section 11 (FIG. 4D).

The rotating shafts 9*b* and 10*b* supporting the screw augers 9*a* and 10*a* are arranged parallel to the rotational shafts of the magnetic developing roller 8 and the image-carrying member 1, and are juxtaposed in a vertical relationship. The first screw auger 9*a* in the first screw auger section 9 agitates and transfers developer onto the magnetic developing roller 8. The second screw auger section 10 collects developer remaining after the magnetic developing roller 8 has developed a latent image formed on the image-carrying member 1 into a visible image with toner, and developer conveyed from the first screw auger section 9 via the third opening N3. The screw auger 10*a* is rotated to agitate and convey this developer in the direction of the outline arrow 34 (FIG. 4D) so that developer accumulates on the left end of the second screw auger section 10 in FIG. 4D. As the developer accumulates, some of the developer is supplied into the third screw auger section 11 via the first opening N1.

As is shown in FIGS. 4B, 4C, and 4D, the third screw auger section 11 is arranged at a slant to the conveying direction of developer, that is, arranged in the direction of the outline arrow 36) so that the downstream axial end lid of the third screw auger 11*a* is positioned higher than the upstream axial end 11*c* of the screw auger 11*a*. However, when viewed from above, the third screw auger 11*a* is parallel to the rotational shafts of the image-carrying member 1 and magnetic developing roller 8. The axial ends 11*c* and 11*d* of the third screw auger 11*a* are positioned at heights between the rotating shafts 9*b* and 10*b*.

The third screw auger 11*a* agitates the developer in the third screw auger section 11 while conveying the developer in the direction of the outline arrow 36 along with developer supplied from the second screw auger section 10 and new toner supplied through the supply opening N4. The developer accumulates at the downstream side of the third screw auger section 11 (right end in FIG. 4D). As the developer accumulates, some of the developer is supplied into the upstream side of the first screw auger section 9 via the opening N2 formed in the third screw auger section 11.

As described above, the first screw auger 9*a* rotates to agitate developer supplied into the first screw auger section 9, while conveying the developer in the direction of the outline arrow 35.

The first screw auger 9*a* agitates developer in the first screw auger section 9 while supplying the developer to the magnetic developing roller 8. The sleeve of the magnetic developing roller 8 rotating in a clockwise direction attracts developer supplied to the magnetic developing roller 8 with a magnetic force, thereby forming a magnetic brush.

While the developing device of the preferred embodiment employs a magnetic developing roller and uses a double-component developer configured of a toner and a carrier, when using a single-component developer, it is possible to use a developing roller that does not employ magnets to attract the developer.

The blade 12 regulates the height of the magnetic brush and returns developer exceeding the prescribed height to the first screw auger section 9.

The magnetic developing roller 8 conveys the magnetic brush regulated at the prescribed height over the image-carrying member 1 so that toner in the developer becomes deposited on the latent image formed on the image-carrying member 1, developing the latent image into a toner image.

In the present embodiment, supply openings 13 are formed at prescribed intervals in a portion of the partitioning wall 15 opposing the first screw auger section 9. A portion of the developer conveyed in the first screw auger section 9 is returned through the supply openings 13 into the third screw auger section 11.

Some developer in the first screw auger section 9 that is conveyed toward but not supplied onto the magnetic developing roller 8 drops into the third screw auger section 11 through the supply openings 13 formed in the partitioning wall 15, or accumulates at the downstream side of the first screw auger section 9 (left end in FIG. 4D) and drops into the second screw auger section 10 through the third opening N3.

Developer used for development that has a depleted toner concentration falls from the magnetic developing roller 8 into the second screw auger section 10. The second screw auger 10*a* agitates this developer and conveys the developer toward a downstream end of the second screw auger section 10 (to the left in FIG. 4D).

Developer conveyed to the downstream end of the second screw auger section 10 migrates through the first opening N1 into the third screw auger section 11. The third screw auger 11*a* agitates the developer received through the first opening N1 while conveying this developer toward a downstream end. (to the right in FIG. 4D) together with toner supplied through the supply opening N4 and developer returned from the first screw auger section 9 into the third screw auger section 11 via the supply openings 13.

In the preferred embodiment, as shown in FIG. 4D, a toner concentration sensor 14 is mounted in the partitioning wall 15 near the downstream end of the third screw auger section 11. The supply openings 13 are formed upstream of the opening N2. Here, it is preferable to form the supply openings 13 upstream of the toner concentration sensor 14 since the toner concentration sensor 14 can more appropriately detect the toner concentration. Amount of toner supplied to the first screw auger section 9 via the supply opening N4 is determined based on detection result by the toner concentration sensor 14.

Developer passing over the toner concentration sensor 14 is conveyed to a downstream end of the third screw auger 11*a* and migrates into the first screw auger section 9 via the opening N2.

The developer that migrates into the first screw auger section 9 is once again supplied onto the magnetic developing roller 8 for developing the latent image formed on the image-carrying member 1. Developer that is not supplied onto the magnetic developing roller 8 returns to the third screw auger section 11 through the supply openings 13.

Developer having a greatly depleted toner concentration after being used for development is mixed with developer that has a stable toner concentration and is returned from the first screw auger section 9 through the supply openings 13. Since the returned toner is supplied from the supply opening 13 formed at a plurality of locations, the toner concentration of the mixed toner is stable even if the mixed toner is not agitated sufficiently. Accordingly, it is not necessary to drastically increase the amount of new toner supplied to the third screw auger section 11 from the supply opening N4 in order to achieve a relatively stable toner concentration. Since a large amount of toner is not supplied to the third auger section 11 through the supply opening N4, a stable toner concentration can be maintained at all times even if the mixed toner is not agitated sufficiently.

In the present embodiment, the toner concentration sensor 14 is disposed at the downstream end of the third screw auger section 11, while the supply openings 13 are disposed upstream of the toner concentration sensor 14. With this construction, the toner concentration sensor 14 can detect the toner concentration of the developer replenished with new toner. Thus, the toner concentration sensor 14 can more accurately detect the toner concentration.

The rotational shaft 11*b* of the third screw auger 11*a* is arranged either parallel or sloped to the rotational shafts 9*b*, 10*b* of the first and second screw augers 9*a*, 10*a*. This construction can supply developer to the developing roller 8 appropriately.

Next, a developing device according to a variation of the embodiment will be described with reference to FIGS. 5A and 5B.

Figure 5A:
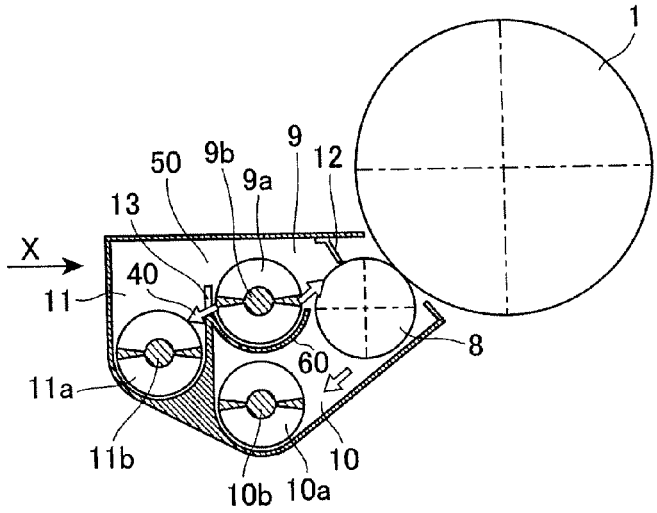
FIG. 5A is a cross-sectional view showing the structure of a developing device according to a variation of the embodiment.
Figure 5B:
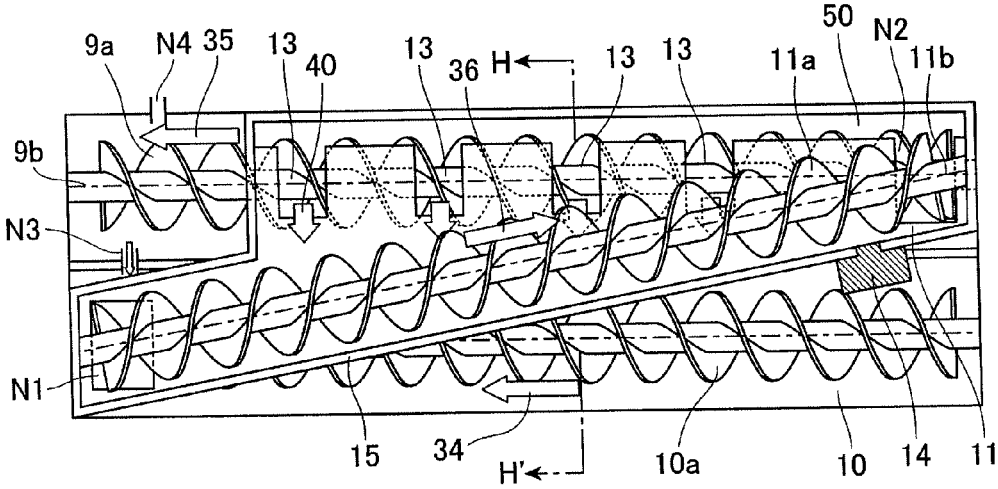
FIG. 5B is a side view from a perspective along a direction X shown in FIG. 5A revealing the interior of the developing device.

FIG. 5A is a center cross-sectional view taken along a line H-H' in FIG. 5B showing the structure of the developing device 4 according to a variation of the embodiment. FIG. 5B is a side view from a perspective along a direction X shown in FIG. 5A revealing the interior of the developing device 4.

In the variation of the embodiment shown in FIGS. 5A and 5B, a cutout part 50 is formed in the upper section of the partitioning wall 15 in communication with the third screw auger section 11. In addition, the supply openings 13 are formed at appropriate intervals in the partitioning wall 15 and are cut deeper than the cutout part 50.

With this construction, a portion of developer in the first screw auger section 9 can be supplied to the third screw auger section 11 via the supply openings 13.

Figure 6:
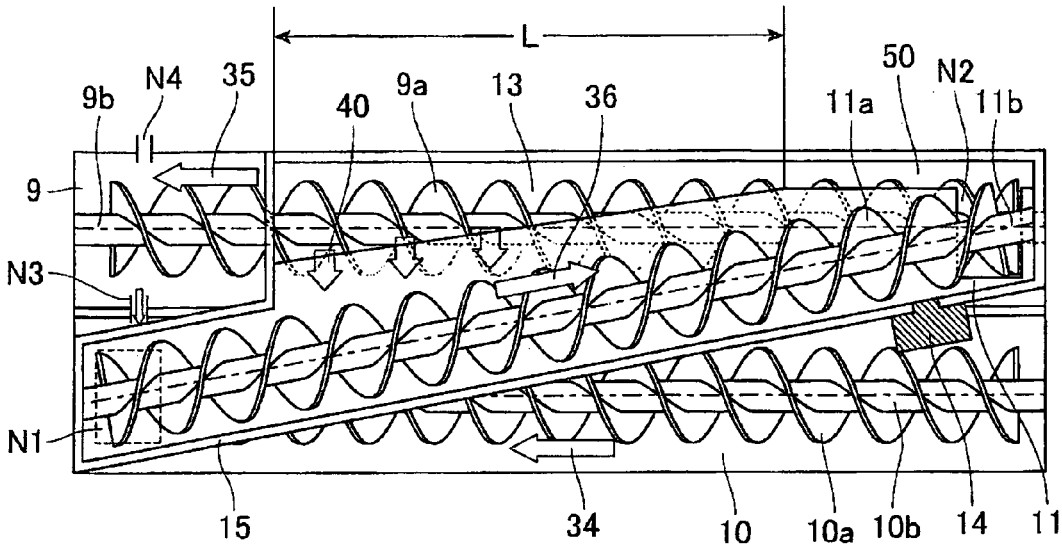
FIG. 6 is a side view illustrating the interior structure of a developing device according to another variation of the embodiment.
Figure 7:
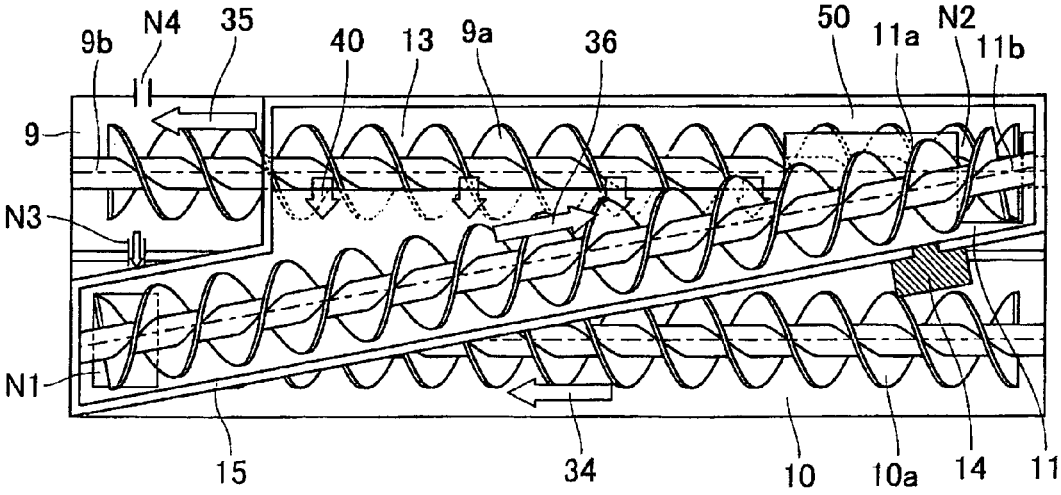
FIG. 7 is a side view illustrating the interior structure of a developing device according to another variation of the embodiment.

FIGS. 6 and 7 also show developing devices according to variations of the embodiment. The drawings in FIGS. 6 and 7 correspond to the side view shown in FIG. 5B and illustrate variations of the supply opening 13.

In FIG. 6, the cutout part 50 is formed in the upper portion of the partitioning wall 15. The supply opening 13 is formed in the third screw auger section 11 on the upstream side of the toner concentration sensor 14 and over a region having a length L. The supply opening 13 is cut at a slope that deepens toward the downstream side of the first screw auger section 9. In the variation shown in FIG. 7, the cutout part 50 is cut out in the third screw auger section 11 upstream of the toner concentration sensor 14 at a uniform depth that follows the downstream side of the first screw auger section 9.

In either of these variations, a portion of developer can be supplied appropriately from the first screw auger section 9 into the third screw auger section 11 via the supply opening 13.

While the invention has been described in detail with reference to the specific embodiment thereof, it would be apparent to those skilled in the art that various changes and modifications may be made therein without departing from the spirit of the invention.

For example, in the above-described embodiments, the developing device described above requires at least three screw auger sections having screw augers for agitating and conveying developer. However, the developing device may be provided with additional screw auger sections according to need.

What is claimed is:

1. A developing device comprising:

a first section, a second section and a third section configured to accommodate developer including toner and carrier therein, and having a first screw auger, a second screw auger and a third screw auger respectively that rotate to agitate and convey the developer;

a developing roller that supplies developer to an image-carrying member on which latent images are formed in order to develop the latent image;

a partitioning wall extending in a vertical direction that isolates the third section from the first section and the second section, a first opening and a plurality of supply openings being formed in portions of the partitioning wall opposing the first section, a second opening being formed in a portion of the partitioning wall opposing the second section; and a toner concentration detector disposed in the third section, and detecting concentration of toner in developer accommodated in the third section;

wherein the first screw auger conveys developer accommodated in the first section to the developing roller, into the third section via the plurality of supply openings opening, and into the second section, wherein the second screw auger conveys developer accommodated in the second section into the third section via the second opening, wherein the third screw auger conveys developer accommodated in the third section into the first section via the first opening, toner being replenished into the third section based on a detection result by the toner concentration detector.

2. The developing device according to claim 1, wherein the second screw auger conveys developer remaining on the developing roller after the developing roller has developed the latent image into the third section via the second opening, in addition to the developer conveyed into the second section by the first screw auger.

3. The developing device according to claim 1, wherein the third screw auger conveys, into the first section, the developer conveyed into the third section by the second screw auger, the developer conveyed into the third section via the supply openings by the first screw auger, and the toner replenished into the third section.

4. The developing device according to claim 1, wherein the supply openings are positioned upstream of the toner concentration detector in a conveying direction of developer in the third section.

5. The developing device according to claim 1, wherein a replenishing opening is formed at the third section upstream of the supply openings in a conveying direction of developer in the third section.

6. The developing device according to claim 1, wherein the second opening is formed at an upstream of the supply openings in a conveying direction of developer in the third section.

7. The developing device according to claim 1, wherein the first screw auger, the second screw auger and the third screw auger include a first rotational shaft, a second rotational shaft and a third rotational shaft respectively, wherein the first rotational shaft, the second rotational shaft and the third rotational shaft are arranged parallel to a rotational shaft of the image-carrying member.

8. The developing device according to claim 1, wherein the first screw auger, the second screw auger and the third screw auger include a first rotational shaft, a second rotational shaft and a third rotational shaft respectively, wherein the first rotational shaft and the second rotational shaft are arranged parallel to a rotational shaft of the image-carrying member, and the third rotational shaft is arranged at an incline with respect to the rotational shaft of the image-carrying member.

9. An image-forming device comprising:

an image-carrying member on which latent images are formed; and a developing device comprising:

a first section, a second section and a third section configured to accommodate developer including toner and carrier therein, and having a first screw auger, a second screw auger and a third screw auger respectively that rotate to agitate and convey the developer;

a developing roller that supplies developer to the image carrying member in order to develop the latent image on the image carrying member;

a partitioning wall extending in a vertical direction that isolates the third section from the first section and the second section, a first opening and a plurality of supply openings being formed in portions of the partitioning wall opposing the first section, a second opening being formed in a portion of the partitioning wall opposing the second section; and a toner concentration detector disposed in the third section, and detecting concentration of toner in developer accommodated in the third section;

wherein the first screw auger conveys developer accommodated in the first section to the developing roller, into the third section via the plurality of supply openings, and into the second section, wherein the second screw auger conveys developer accommodated in the second section into the third section via the second opening, wherein the third screw auger conveys developer accommodated in the third section into the first section via the first opening, toner being replenished into the third section based on a detection result by the toner concentration detector.

10. The image-forming device according to claim 9, wherein the second screw auger conveys developer remaining on the developing roller after the developing roller has developed the latent image into the third section via the second opening, in addition to the developer conveyed into the second section by the first screw auger.

11. The image forming device according to claim 9, wherein the third screw auger conveys, into the first section, the developer conveyed into the third section by the second screw auger, the developer conveyed into the third section via the supply opening by the first screw auger, and the toner replenished into the third section.

12. The image forming device according to claim 9, wherein the supply openings are positioned upstream of the toner concentration detector in a conveying direction of developer in the third section.

13. The image forming device according to claim 9, wherein a replenishing opening is formed at the third section and at an upstream of the supply opening in a conveying direction of developer in the third section.

14. The image forming device according to claim 9, wherein the second opening is formed at an upstream of the supply openings in a conveying direction of developer in the third section.

15. The image forming device according to claim 9, wherein the first screw auger, the second screw auger and the third screw auger include a first rotational shaft, a second rotational shaft and a third rotational shaft respectively, wherein the first rotational shaft, the second rotational shaft and the third rotational shaft are arranged parallel to a rotational shaft of the image-carrying member.

16. The image-forming device according to claim 9, wherein the first screw auger, the second screw auger and the third screw auger include a first rotational shaft, a second rotational shaft and a third rotational shaft respectively, wherein the first rotational shaft and the second rotational shaft are arranged parallel to a rotational shaft of the image carrying member, and the third rotational shaft is arranged at an incline with respect to the rotational shaft of the image-carrying member.

17. A developing device comprising:

a first section, a second section and a third section configured to accommodate developer including toner and carrier therein, and having a first screw auger, a second screw auger and a third screw auger respectively that rotate to agitate and convey the developer;

a developing roller that supplies developer to an image-carrying member on which latent images are formed in order to develop the latent image;

a partitioning wall extending in a vertical direction that isolates the third section from the first section and the second section, a first opening and a plurality of supply openings being formed in portions of the partitioning wall opposing the first section, a second opening being formed in a portion of the partitioning wall opposing the second section; and a toner concentration detector disposed in the third section on the partition wall near a downstream end of the third screw auger, and detecting concentration of toner in developer accommodated in the third section;

wherein the first screw auger conveys developer accommodated in the first section to the developing roller, into the third section via the plurality of supply openings, and into the second section, wherein the second screw auger conveys developer accommodated in the second section into the third section via the second opening, wherein the third screw auger conveys developer accommodated in the third section into the first section via the first opening, toner being replenished into the third section based on a detection result by the toner concentration detector.

18. A developing device comprising:

a first section, a second section and a third section configured to accommodate developer including toner and carrier therein, and having a first screw auger, a second screw auger and a third screw auger respectively rotatably supported in the first, second and third sections to agitate and convey the developer, the second screw auger being arranged below the first screw auger and the third screw auger is arranged at an incline so that a downstream axial end of the third screw auger adjacent the first screw auger is positioned higher than the upstream axial end of the screw auger adjacent the second screw auger;

a magnetic developing roller that supplies developer to an image-carrying member on which latent images are formed in order to develop the latent image;

a partitioning wall extending in a vertical direction that isolates the third section from the first section and the second section and a partitioning portion of the partitioning wall that isolates the first section from the second section, a first opening formed in a portion of the partitioning wall opposing the second section, a second opening formed in a portion of the partitioning wall opposing the first section, a third opening is formed in the partitioning portion that isolates the first section from the second section, and a plurality of supply openings formed at prescribed intervals in a portion of the partitioning wall opposing the first screw auger section so that a portion of the developer conveyed in the first screw auger section is returned through the supply openings into the third screw auger section; and a toner concentration sensor disposed in the third section near the downstream end of the third screw auger section, and detecting concentration of toner in developer accommodated in the third section;

wherein the second screw auger conveys developer accommodated in the second section into the third section via the first opening, wherein the third screw auger conveys developer accommodated in the third section into the first section via the second opening, toner being replenished into the third section based on a detection result by the toner concentration detector.

* * * * *